US006113715A

United States Patent [19]

Halander et al.

[11] Patent Number: 6,113,715

[45] Date of Patent: Sep. 5, 2000

[54] METHOD FOR FORMING AN EMULSION EXPLOSIVE COMPOSITION

[75] Inventors: John B. Halander, Murray; Kerry S. Atkinson, Lehi, both of Utah

[73] Assignee: Dyno Nobel Inc., Salt Lake City, Utah

[21] Appl. No.: 09/112,213

[22] Filed: Jul. 9, 1998

[51] Int. Cl.[7] ..... C06B 21/00

[52] U.S. Cl. ..... 149/109.6; 142/2; 142/46

[58] Field of Search ..... 149/2, 46, 109.6

[56] References Cited

U.S. PATENT DOCUMENTS

| | | | |
|---|---|---|---|
| 3,773,573 | 11/1973 | Slykhouse . | |
| 4,097,316 | 6/1978 | Mullay | 149/2 |
| 4,207,126 | 6/1980 | Ekman | 149/109.6 |
| 4,410,378 | 10/1983 | Hattori et al. | 149/109.6 |
| 4,474,628 | 10/1984 | Sudweeks et al. . | |
| 4,511,412 | 4/1985 | Kakino et al. | 149/109.6 |
| 4,511,414 | 4/1985 | Matsui et al. | 149/109.6 |
| 4,737,207 | 4/1988 | Ehrnstrom et al. | 149/2 |
| 4,820,361 | 4/1989 | McKenzie et al. . | |
| 4,931,110 | 6/1990 | McKenzie et al. . | |
| 4,948,440 | 8/1990 | Cribb et al. | 149/109.6 |
| 5,472,529 | 12/1995 | Arita et al . | 149/2 |
| 5,540,793 | 7/1996 | Bals et al. . | |

FOREIGN PATENT DOCUMENTS 2010239B of 0000 United Kingdom .

OTHER PUBLICATIONS

*Expancel Technical Bulletin No. 14,* Jun. 2, 1995.

*Primary Examiner*—Edward A. Miller

[57] ABSTRACT

The invention relates to methods for forming an emulsion explosive composition and to methods for sensitizing an emulsion explosive composition. The methods involve the in-situ expansion of organic microspheres during the formation of the emulsion explosive composition.

34 Claims, No Drawings

METHOD FOR FORMING AN EMULSION EXPLOSIVE COMPOSITION

BACKGROUND OF THE INVENTION

Emulsion explosive compositions are well-known in the art. As used herein the term "emulsion" refers to a water-in-oil emulsion comprising an inorganic oxidizer salt solution as a discontinuous phase and an organic liquid fuel as a continuous phase. See for example, U.S. Pat. Nos. 4,474,628; 4,820,361 and 4,931,110.

Most emulsion explosive compositions have their natural densities purposely reduced to thereby increase their sensitivity to a desired or required level for detonation. Sensitivity often is increased to a level to allow the composition to be detonable by the initiating shock produced from a commercial blasting cap or detonator. Such compositions are commonly termed "cap sensitive." Other compositions are designed to be detonated by a booster or primer rather than detonators, and thus their sensitivities are designed to be at a lower level. Compositions having this lesser degree of sensitivity are deemed non-cap sensitive and are commonly called blasting agents. The more sensitive compositions are generally made or used in smaller charge diameters in either packaged or bulk form.

The commonly used means of density reduction is the addition of density reducing agents to an already formed emulsion. Such density reducing agents include hollow glass or organic microspheres, porous ammonium nitrate (AN) prills, perlite and chemical gassing agents, such as sodium nitrite that decompose chemically in the composition to produce a dispersion of gas bubbles throughout the composition. Air bubbles also can be entrained during mixing or stirring of the composition.

The use of solid, hollow microspheres often is the preferred form of density reducing agent, since they are less compressible under pressure (such as in deep bore holes), they can be incorporated into the composition in desired quantities by relatively simple mechanical means as is known in the art, and they remain stable and distinct rather than being prone to migrate and coalesce as air or gas bubbles do, especially during movement or handling of the emulsion. Their use is not without problems, however, since they are relatively expensive and they present some pre-incorporation handling problems. Because of their low bulk density (typically 0.3 g/cc or lower), they are relatively expensive to transport. Because of their small particle size (average particle diameter of 40–70 microns) and lower density, they can present difficult handling problems. For example, the microspheres easily can become an airborne dust problem if they are stirred or otherwise perturbed in an open environment, potentially creating health and safety hazards. These transportation and handling problems significantly are minimized by the methods of the present invention which allow for the in situ expansion of organic microspheres during the emulsion formation process.

The microspheres used in the present invention are unexpanded organic microspheres, which can be supplied in wet or dry form. organic microspheres have an advantage over glass microspheres in that organic microspheres also act as a fuel that is consumed in the detonation and thus contribute to the energy of the explosive. They typically are heat expanded, however, prior to their incorporation into an explosive composition, and thus the handling problems described above must be addressed. Further, this pre-expansion and drying (if done) requires specialized, costly equipment and processing. Also, the particle size and volume of unexpanded microspheres are significantly less than for expanded microspheres (of any type) and thus the unexpanded microspheres can be transported more efficiently and cost effectively.

The present invention comprises the addition of unexpanded microspheres to a heated component of the emulsion explosive composition during the emulsion formation process. This allows for the in situ expansion of the microspheres in the emulsion explosive composition and thus eliminates the handling and transporting problems described above and the need for costly expanding, drying and other processing equipment. Additionally, it has been found that the detonation velocity is increased by this method as compared to the use of conventionally expanded microspheres.

The in situ expansion of organic microspheres in certain types of explosive compositions has been suggested in the prior art. U.S. Pat. No. 3,773,573 suggests that microspheres may be incorporated into a pre-formed water gel explosive in an unexpanded form and expanded in situ. U.K. patent no. 2,010,239 B discloses the heating and expanding of organic microspheres in an aqueous oxidizer salt solution or eutectic melt prior to combining with the fuel and other components to form a water gel explosive. In a somewhat different approach, U.S. Pat. No. 5,540,793 discloses the addition of microspheres to porous prilled AN during the prilling process. The microspheres disclosed are of various kinds and the organic microspheres can be expanded during the prilling process.

The methods of the present inventions differ from these prior art disclosures in that the in situ expansion occurs during the formation of a water-in-oil emulsion explosive composition. It surprisingly has been found that such in situ expansion occurs with a high efficiency and at significantly lower temperatures when compared to organic microspheres that are pre-expanded using conventional techniques prior to incorporation into an explosive. In addition, a method of the present invention allows for only a portion or component of the emulsion explosive composition to be heated to the expansion temperature rather than the whole composition, and thus this method is more energy efficient and enhances emulsion stability since the final composition is at, or can be cooled more easily to, a lower temperature which is conducive to stability.

Thus one object of the present invention is to provide a method for the in situ expansion of organic microspheres in an emulsion explosive composition. Another object is to provide a method for in situ expansion of organic microspheres in an emulsion explosive composition, which method is energy efficient and enhances final emulsion stability. Another object is to provide a method for improving the efficiency of expansion of organic microspheres at lower temperatures during the formation of an emulsion explosive composition.

SUMMARY OF THE INVENTION

A method of sensitizing and of forming an emulsion explosive composition comprises forming a fuel phase comprising an organic liquid fuel, an emulsifier and unexpanded organic microspheres, with such fuel phase being at a temperature below the expansion temperature of the organic microspheres; forming an inorganic oxidizer salt solution at an elevated temperature above the expansion temperature of the organic microspheres; and mixing together the fuel phase and the oxidizer solution with sufficient shear to form a water-in-oil emulsion and to allow the elevated temperature of the oxidizer solution to expand the organic microspheres and thereby lower the density and increase the sensitivity of the emulsion explosive composition. Other methods comprise adding unexpanded organic microspheres to a portion or component of the emulsion explosive composition that is at or heated to a temperature above the expansion temperature of the microspheres, allowing the microspheres to expand in this mixture and then combining this mixture with the remaining components to form the emulsion explosive composition.

DETAILED DESCRIPTION OF THE INVENTION

The emulsion explosive compositions formed by the methods of the invention comprise a continuous phase of organic liquid fuel, a discontinuous phase of inorganic oxidizer salt solution and a dispersion of sensitizing and density-reducing organic microspheres that were expanded in situ during the emulsion formation process.

The immiscible organic fuel forming the continuous phase of the composition is present in an amount of from about 3% to about 12%, and preferably in an amount of from about 4% to about 8% by weight of the composition. The actual amount used can be varied depending upon the particular immiscible fuel(s) used and upon the presence of other fuels, if any. The immiscible organic fuels can be aliphatic, alicyclic, and/or aromatic and can be saturated and/or unsaturated, so long as they are liquid at the formulation temperature. Preferred fuels include tall oil, mineral oil, waxes, paraffin oils, benzene, toluene, xylenes, mixtures of liquid hydrocarbons generally referred to as petroleum distillates such as gasoline, kerosene and diesel fuels, and vegetable oils such as corn oil, cottonseed oil, peanut oil, and soybean oil. Particularly preferred liquid fuels are mineral oil, No. 2 fuel oil, paraffin waxes, microcrystalline waxes, and mixtures thereof. Aliphatic and aromatic nitrocompounds and chlorinated hydrocarbons also can be used. Mixtures of any of the above can be used.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed below. These additional solid and/or liquid fuels can be added generally in amounts ranging up to about 25% by weight. If desired, undissolved oxidizer salt can be added to the composition along with any solid or liquid fuels.

The inorganic oxidizer salt solution forming the discontinuous phase of the explosive generally comprises inorganic oxidizer salt, in an amount from about 45% to about 95% by weight of the total composition, and water and/or water-miscible organic liquids, in an amount of from about 0% to about 30%. The oxidizer salt preferably is primarily ammonium nitrate (AN), but other salts may be used in amounts up to about 50%. The other oxidizer salts are selected from the group consisting of ammonium, alkali and alkaline earth metal nitrates, chlorates and perchlorates. Of these, sodium nitrate (SN) and calcium nitrate (CN) are preferred. AN and ANFO prills also can be added in solid form as part of the oxidizer salt in the final composition.

Water generally is employed in an amount of from 3% to about 30% by weight based on the total composition. It is commonly employed in emulsions in an amount of from about 5% to about 20%, although emulsions can be formulated that are essentially devoid of water.

Water-miscible organic liquids can at least partially replace water as a solvent for the salts, and such liquids also function as a fuel for the composition. Moreover, certain organic compounds also reduce the crystallization temperature of the oxidizer salts in solution. Miscible solid or liquid fuels can include alcohols such as sugars and methyl alcohol, glycols such as ethylene glycols, amides such as formamide, amines, amine nitrates, urea and analogous nitrogen-containing fuels. As is well known in the art, the amount and type of water-miscible liquid(s) or solid(s) used can vary according to desired physical properties.

An emulsifier is used in forming the emulsion. Typical emulsifiers include sorbitan fatty esters, glycol esters, substituted oxazolines, alkylamines or their salts, derivatives thereof and the like. More recently, certain polymeric emulsifiers have been found to impart better stability to emulsions under certain conditions. U.S. Pat. No. 4,820,361 describes a polymeric emulsifier derivatized from trishydroxymethylaminomethane and polyisobutenyl succinic anhydride ("PIBSA"), which is particularly effective in combination with organic microspheres and is a preferred emulsifier. U.S. Pat. No. 4,784,706 discloses a phenolic derivative of polypropene or polybutene. Other derivatives of polypropene or polybutene have been disclosed. Preferably the polymeric emulsifier comprises polymeric amines and their salts or an amine, alkanolamine or polyol derivative of a carboxylated or anhydride derivatized olefinic or vinyl addition polymer. U.S. Pat. No. 4,931,110 discloses a polymeric emulsifier comprising a bis-alkanolamine or bis-polyol derivative or a bis-carboxylated or anhydride derivatized olefinic or vinyl addition polymer in which the olefinic or vinyl addition polymer chain has an average chain length of from about 10 to about 32 carbon atoms, excluding side chains or branching.

The organic microspheres which are expanded in situ preferably are copolymers of vinylidine chloride and acrylonitrite with a low boiling point hydrocarbon blowing agent. They are added in unexpanded form in an amount of from about 0.1% by weight of the composition to about 2.0%, depending on the desired level of sensitivity and density reduction. The microspheres can be obtained in either dry or wet (about 18 to 36% by weight water) form. The density of the emulsion explosive composition is reduced from about 3% to about 25%, but can be reduced as much as 65%. The sensitivity can be increased to a level such that the composition is detonable by a blasting cap. Obviously, the sensitivity can be adjusted to lower levels as well. In addition to the microspheres, chemical gassing and mechanical air entrainment can be used to reduce the density further.

The preferred form of organic microspheres are manufactured under the trademark EXPANCEL. They are available in either expanded or unexpanded form. For use as a density reducing agent in explosives, they typically are added in already expanded form, having been expanded at high temperatures (generally above 120° C.) in either a hot gas or liquid medium. The pre-expanded microspheres consist of a thermoplastic shell encapsulating a gas.

When the microspheres are heated, the thermoplastic shell softens, at the same time the gas increases its pressure thus resulting in an expansion of the spheres. A pre-expanded microsphere of particle size of 10 $\mu$m, for example, can expand to a particle size (sphere diameter) of 40 $\mu$m or more, with a corresponding increase in volume of 64 times or more.

In one embodiment, the unexpanded organic microspheres, emulsifier and organic liquid fuel are combined to form a fuel phase that preferably is heated to a temperature that is above ambient but below 85° C. so that no appreciable amount of expansion of the microspheres occurs. This pre-heating of the fuel phase is found to enhance the expansion efficiency later in the process. This fuel phase then is combined with the oxidizer salt solution which is at a temperature above the minimum expansion temperature of the microspheres, at least 85° C. or higher. The resulting mixture is stirred with sufficient shearing action to form an emulsion of the oxidizer salt solution in a continuous organic liquid fuel phase. The turbulent mixing or shearing of the fuel phase with the oxidizer salt solution surprisingly enables the expansion to occur at a high efficiency at significantly lower temperatures than that disclosed in published literature. Additionally, it is believed there is pre-softening of the microspheres due to the organic phase being in contact with the microspheres at elevated temperatures. This pre-softening apparently enhances the ease of expansion, and the fuel phase ingredients can be selected so as to promote this phenomenon.

Another method comprises adding the unexpanded microspheres to a portion or component of the emulsion explosive composition that is at or heated to a temperature above the expansion temperature of the microspheres. The microspheres then expand in this mixture prior to adding and mixing it with the remaining portion or components of the emulsion explosive composition. (Alternatively, the unexpanded microspheres can be combined with the portion or component and then the resulting mixture can be heated to a temperature above the expansion temperature either directly or by addition to a second heated component.) More specifically, the unexpanded microspheres can be combined with a portion of the oxidizer salt solution, the water, a dilute oxidizer salt solution, a portion of the emulsion itself or a portion of the fuel phase, which portion or component is at or heated to a temperature above the expansion temperature in order to allow the microspheres to expand in the resulting mixture prior to combining it with the remaining portion or components of the final composition. This method is energy efficient, since only part of the composition is heated above the expansion temperature, and enhances final emulsion stability, since the final composition is at, or can be cooled more quickly to, a lower, stabilizing temperature. Various modifications of this method will be apparent to those skilled in the art. For example, the unexpanded microspheres could be added to a portion of the oxidizer salt solution that is at a temperature above the expansion temperature. The resulting mixture then can be added to the remaining portion of the oxidizer salt solution prior to the formation of the emulsion in a conventional manner. Other combinations and procedural variations are possible as well.

It has been found to be advantageous to predissolve the emulsifier in the organic liquid fuel prior to adding the fuel phase to the oxidizer salt solution. This method allows the emulsion to form quickly upon agitation and also allows the "wet" unexpanded microspheres to disperse uniformly. However, the emulsifier may be added separately as a third component if desired.

The unexpanded organic microspheres also can be added to and mixed uniformly throughout a pre-formed emulsion that is at a temperature above the expansion temperature of the microspheres to allow them to expand and thereby lower the density and increase the sensitivity of the emulsion to form an emulsion explosive composition.

The invention is further illustrated by reference to the following examples.

Method 1. An emulsion explosive composition was formed by adding 0.5% by weight of the composition of EXPANCEL 551 wet, unexpanded (WU) organic microspheres to a 6.0% organic fuel phase at a temperature of about 50° C. The microsphere/fuel phase mixture then was combined with 93.5% of an oxidizer salt solution at about 105° C. and the resulting mixture was subjected to shearing action. The microspheres expanded in concert with the formation of the emulsion. The density of the final composition was 1.18 g/cc at about 100° C. The formulation of the composition is shown in Table I.

Method 2. A fuel lean emulsion was formed by combining about 5.4% by weight of organic liquid fuel at a temperature of about 50° C. and 93.5% inorganic oxidizer salt solution at about 120° C. The resulting emulsion was allowed to equilibrate to about 110° C. A homogenous mixture comprising the remaining organic liquid fuel in an amount of about 0.6% and 0.5% EXPANCEL 551 unexpanded microspheres, was added to and uniformly mixed throughout the emulsion. The microspheres expanded and provided a final product density of 1.23 g/cc at about 95° C. The formulation of the composition is shown in Table I.

Method 3. An emulsion explosive composition was formed by adding 0.5% EXPANCEL 551 WU (wet, unexpanded) microspheres to a 6.0% organic fuel phase at about 70° C. Then 95% by weight of an inorganic oxidizer solution was divided into portions A and B, which were both at a temperature of about 80° C. Portion A comprised about 30% of the total oxidizer solution. (Portion A can comprise from about 10% to about 50% of the total oxidizer solution but preferably comprises about 25% to 30%.) Portion A was passed through an in-line heat exchanger where it was heated to about 110° C. The heated portion A then was combined with the fuel phase/microsphere mixture prior to entering an in-line static mixer. The heat imparted to the microspheres by portion A, coupled with moderate mixing in the static mixer, caused the microspheres to expand uniformly. The resultant mixture then was combined with portion B of the oxidizer solution, which produced a combined mixture temperature of about 80° C. prior to entering a dynamic mixer where the emulsion was formed. The final product density was about 1.18 g/cc at 75° C. The formulation of the composition was the same as that shown in Table I.

Product produced according to Method 1 above was tested for its detonation characteristics 24 hours after its formation. The emulsion explosive composition had a density of 1.22 g/cc and produced a detonation velocity of 5.9 km/sec in a 75mm cardboard tube at 5° C. It had a minimum booster at 5° C. of 2 g of pentolite and a critical diameter of 25 mm with a detonation velocity of 5.8 km/sec. Product produced according to Method 3 above also was tested for its detonation characteristics 24 hours after its formation. The detonation velocity was 5.8 km/sec in a 75 mm cardboard tube at 20° C. The critical diameter was 30 mm at 20° C. in a density of 1.24 g/cc. The minimum booster was 2 g at 20° C.

While the present invention has been described with reference to certain illustrative examples and preferred embodiments, various modifications will be apparent to those skilled in the art and any such modifications are intended to be within the scope of the invention as set forth in the appended claims.

TABLE I

| | | |
|---|---|---|
| Oxidizer Solution[1] | | 93.5 |
| Fuel Phase[2] | | 6.0 |
| Density Control Unexpanded[3] Plastic Spheres (Wet or Dry) | | 0.5 |
| [1]Oxidizer Solution: | AN | 80.0 |
| | $H_2O$ | 20.0 |
| [2]Fuel Phase: | Polymeric (Emulsifier) | 15.0 |
| | SMO (Emulsifier) | 10.0 |
| | Mineral Oil | 37.5 |
| | Fuel Oil | 37.5 |
| [3]Unexpanded Plastic Microspheres (Wet or Dry) | | 0.5 |
| Wt. Percent of Total Product | | |

What is claimed is:

1. A method of sensitizing an emulsion explosive composition comprising forming a fuel phase comprising an organic liquid fuel, an emulsifier and unexpanded organic microspheres, with such fuel phase being at a temperature below the expansion temperature of the organic microspheres; forming an inorganic oxidizer salt solution at an elevated temperature above the expansion temperature of the organic microspheres; and mixing together the fuel phase and the oxidizer solution with sufficient shear to form a water-in-oil emulsion and to allow the elevated temperature of the oxidizer solution to expand the organic microspheres and thereby lower the density and increase the sensitivity of the emulsion explosive composition.

2. A method according to claim 1 wherein the elevated temperature of the oxidizer salt solution phase is at least about 85° C.

3. A method according to claim 1 wherein the temperature of the fuel phase is elevated above ambient but below about 85° C.

4. A method according to claim 1 wherein the organic microspheres are co-polymers of vinylidine chloride and acrylonitrile with a low boiling point hydrocarbon blowing agent.

5. A method according to claim 4 wherein the organic microspheres are present in an amount of from about 0.1% to about 2.0% by weight of the composition.

6. A method according to claim 5 wherein the density of the emulsion explosive composition is reduced from about 3% to about 25%.

7. A method according to claim 6 wherein the sensitivity of the emulsion explosive composition is increased to a level such that the composition is detonable by a blasting cap.

8. A method according to claim 1 wherein at least a portion of the inorganic oxidizer salt solution is at the elevated temperature and a remaining portion of the inorganic oxidizer salt solution is at lower temperature and the fuel phase first is mixed with the elevated temperature portion of the oxidizer solution and then this mixture is mixed with the remaining portion of the oxidizer solution.

9. A method of forming an emulsion blasting composition comprising forming a fuel phase comprising an organic liquid fuel, an emulsifier, and unexpanded organic microspheres, with such fuel phase being at a temperature below the expansion temperature of the organic microspheres; forming an inorganic oxidizer salt solution at an elevated temperature above the expansion temperature of the organic microspheres; and mixing together the fuel phase and the oxidizer solution with sufficient shear to form a water-in-oil emulsion and to allow the elevated temperature of the oxidizer solution to expand the organic microspheres and thereby lower the density and increase the sensitivity of the emulsion explosive composition.

10. A method according to claim 9 wherein the elevated temperature of the oxidizer salt solution phase is at least about 85° C.

11. A method according to claim 9 wherein the temperature of the fuel phase is elevated above ambient but below 85° C.

12. A method according to claim 10 wherein the organic microspheres are co-polymers of vinylidine chloride and acrylonitrile with a low boiling point hydrocarbon blowing agent.

13. A method according to claim 12 wherein the organic microspheres are present in an amount of from about 0.1% to about 2.0% by weight of the composition.

14. A method according to claim 13 wherein the density of the emulsion explosive composition is reduced from about 3% to about 25%.

15. A method according to claim 14 wherein the sensitivity of the emulsion explosive composition is increased to a level such that the composition is detonable by a blasting cap.

16. A method according to claim 9 wherein at least a portion of the inorganic oxidizer salt solution is at the elevated temperature and a remaining portion of the inorganic oxidizer salt solution is at lower temperature and the fuel phase first is mixed with the elevated temperature portion of the oxidizer solution and then this mixture further is mixed with the remaining portion of the oxidizer solution.

17. A method of forming an emulsion explosive composition comprising forming at an elevated temperature a fuel-lean emulsion comprising an inorganic oxidizer salt solution as a discontinuous phase and a portion of an organic liquid fuel as a continuous phase; forming a mixture of a remaining portion of organic liquid fuel and unexpanded organic microspheres, with the mixture being at a temperature below the expansion temperature of the microspheres and the emulsion being at a temperature above the expansion temperature of the organic microspheres; and mixing uniformly the emulsion and the mixture to form a fully fueled emulsion explosive composition wherein the elevated temperature of the emulsion causes expansion of the organic microspheres to thereby lower the density and increase the sensitivity of the emulsion explosive composition.

18. A method according to claim 17 wherein the elevated temperature of the emulsion is at least about 85° C.

19. A method according to claim 17 wherein the temperature of the fuel phase is elevated above ambient but below 85° C.

20. A method according to claim 17 wherein the organic microspheres are co-polymers of vinylidine chloride and acrylonitrile with a low boiling point hydrocarbon blowing agent.

21. A method according to claim 20 wherein the organic microspheres are present in an amount of from about 0.1% to about 2.0% by weight of the composition.

22. A method according to claim 21 wherein the density of the emulsion explosive composition is reduced from about 3% to about 25%.

23. A method according to claim 22 wherein the sensitivity of the emulsion explosive composition is increased to a level such that the composition is detonable by a blasting cap.

24. A method according to claim 17 wherein the remaining portion of organic liquid fuel comprises from about 15% to about 50% of the total organic liquid fuel in the emulsion explosive composition.

25. A method of forming an emulsion explosive composition comprising forming a mixture of unexpanded organic microspheres with a component of the composition that is at or subsequently heated to a temperature above the expansion temperature of the microspheres to allow the microspheres to expand in the mixture and then combining and uniformly mixing the mixture with the remaining components of the emulsion explosive composition.

26. A method according to claim 25 wherein the remaining components of the composition are at a temperature below the expansion temperature of the microballoons.

27. A method according to claim 25 wherein the emulsion explosive composition comprises an organic liquid fuel, an emulsifier, organic microspheres, water, and inorganic oxidizer salt forming a solution with the water.

28. A method according to claim 27 wherein the component is selected from the group consisting of a portion of the organic liquid fuel, a portion of the inorganic oxidizer salt solution, the water, a portion of the inorganic oxidizer salt in solution with the water and a portion of the composition itself.

29. A method according to claim 27 wherein the organic microspheres are co-polymers of vinylidine chloride and acrylonitrile with a low boiling point hydrocarbon blowing agent.

30. A method according to claim 29 wherein the organic microspheres are present in an amount of from about 0.1% to about 2.0% by weight of the composition.

31. A method according to claim 30 wherein the density of the emulsion explosive composition is reduced from about 3% to about 25%.

32. A method according to claim 25 wherein the unexpanded organic microspheres and the component are combined to form a mixture which then is heated to a temperature above the expansion temperature.

33. A method according to claim 25 wherein the mixture first is combined with one or more remaining components which are at a temperature above the expansion temperature so as to heat the mixture and allow the microspheres to expand.

34. A method of forming a sensitized emulsion explosive composition comprising adding unexpanded organic microspheres to a pre-formed emulsion that is at a temperature above the expansion temperature of the microspheres and mixing the microspheres uniformly throughout the emulsion to allow them to expand and thereby lower the density and increase the sensitivity of the emulsion to form an emulsion explosive composition.

* * * * *

UNITED STATES PATENT AND TRADEMARK OFFICE

CERTIFICATE OF CORRECTION

PATENT NO. : 6,113,715
DATED : September 5, 2000
INVENTOR(S) : Halander et al.

It is certified that error appears in the above-identified patent and that said Letters Patent is hereby corrected as shown below:

Column 8,
Line 63, delete claim 25.

Column 9,
Lines 4-23, delete claims 26-30.

Column 10,
Lines 1-21, delete claims 31-34.

Signed and Sealed this

Twenty-eighth Day of September, 2004

JON W. DUDAS
*Director of the United States Patent and Trademark Office*